US011189952B2

(12) United States Patent
Miyakawa et al.

(10) Patent No.: US 11,189,952 B2
(45) Date of Patent: Nov. 30, 2021

(54) CONNECTOR

(71) Applicant: Yazaki Corporation, Tokyo (JP)

(72) Inventors: Tomoyuki Miyakawa, Tochigi (JP); Tomoyoshi Fukaya, Tochigi (JP); Kozo Oishi, Tochigi (JP); Hoshina Chisaka, Tochigi (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/037,717

(22) Filed: Sep. 30, 2020

(65) Prior Publication Data

US 2021/0098923 A1 Apr. 1, 2021

(30) Foreign Application Priority Data

Oct. 1, 2019 (JP) ..... JP2019-181222

(51) Int. Cl.
*H01R 13/424* (2006.01)
*H01R 13/502* (2006.01)
*H01R 13/52* (2006.01)

(52) U.S. Cl.
CPC ..... *H01R 13/424* (2013.01); *H01R 13/502* (2013.01); *H01R 13/5208* (2013.01)

(58) Field of Classification Search
CPC .. H01R 13/428; H01R 13/4361; H01R 13/40; H01R 13/4223; H01R 13/424; H01R 13/436; H01R 13/4362; H01R 13/4364; H01R 13/4365; H01R 13/4367; H01R 13/4368; H01R 13/502; H01R 13/506
See application file for complete search history.

(56) References Cited

U.S. PATENT DOCUMENTS 6,811,423 B2 * 11/2004 Yoshigi ..... H01R 13/641 439/315
2001/0023147 A1 * 9/2001 Kashiyama ..... H01R 13/422 439/488
2002/0173205 A1 * 11/2002 Kato ..... H01R 13/4367 439/752
2007/0072471 A1 * 3/2007 Miyakawa ..... H01R 43/005 439/274

(Continued)

FOREIGN PATENT DOCUMENTS

JP 7-153523 A 6/1995

*Primary Examiner* — Abdullah A Riyami
*Assistant Examiner* — Nader J Alhawamdeh
(74) *Attorney, Agent, or Firm* — Kenealy Vaidya LLP

(57) ABSTRACT

A connector includes: a housing having terminal housing chambers, one passage part, and lances; terminals inserted into the respective terminal housing chambers and locked by the respective lances at a regular position; and a detection member inserted into the passage part to detect whether the terminals are inserted to the regular position. The passage part is adjacent to each of the terminal housing chambers. The lances are provided at a boundary between the respective terminal housing chambers and the passage part. The lances, when the respective terminals are not inserted to the regular position, are pressed by the respective terminals to lock the detection member at a first position. The lances, when the respective terminals are inserted to the regular position, allow the detection member to be inserted into a more inner position than the first position.

6 Claims, 18 Drawing Sheets

(56) References Cited

U.S. PATENT DOCUMENTS

| | | | | |
|---|---|---|---|---|
| 2009/0093168 | A1* | 4/2009 | Takahashi | H01R 13/5025<br>439/709 |
| 2017/0069996 | A1* | 3/2017 | Yamada | H01R 13/4367 |
| 2018/0034187 | A1* | 2/2018 | Sekino | H01R 13/6271 |
| 2018/0069353 | A1* | 3/2018 | Nishiyama | H01R 13/7032 |
| 2021/0098923 | A1* | 4/2021 | Miyakawa | H01R 13/424 |
| 2021/0098925 | A1* | 4/2021 | Miyakawa | H01R 13/4223 |

* cited by examiner

CONNECTOR

CROSS-REFERENCE TO RELATED APPLICATION(S)

The present application claims priority to and incorporates by reference the entire contents of Japanese Patent Application No. 2019-181222 filed in Japan on Oct. 1, 2019.

BACKGROUND OF THE INVENTION

1. Field of the Invention

The present invention relates to a connector.

2. Description of the Related Art

There have conventionally been connectors having a plurality of terminals. Japanese Patent Application Laid-open No. H07-153523 discloses a quasi-waterproof connector having a first connector housing including a terminal holding part housing a plurality of connection terminals, an inner hood part, and an outer hood part.

A connector preferably has a detection member that can detect whether the terminals are properly inserted into a regular position. When the strength of the detection member is attempted to be ensured, the detection member increases in size, which is likely to lead to an increase in the size of the connector.

SUMMARY OF THE INVENTION

An object of the present invention is to provide a connector that can achieve both ensuring the strength of the detection member and preventing an increase in the size of the detection member.

In order to achieve the above mentioned object, a connector according to one aspect of the present invention includes a housing having a plurality of terminal housing chambers each having an insertion port opening toward one side in an axial direction, one passage part opening toward another side in the axial direction, and lances; terminals inserted into the respective terminal housing chambers and locked by the respective lances at a regular position in the respective terminal housing chambers; and a detection member configured to be inserted into the passage part to detect whether the terminals are inserted to the regular position, wherein the passage part being adjacent to each of the terminal housing chambers in a direction orthogonal to the axial direction, each of the lances being provided at a boundary between the respective terminal housing chambers and the passage part, the lances are configured to be pressed by the respective terminals to protrude to the passage part and to lock the detection member at a first position in the passage part when the respective terminals are not inserted to the regular position, and the lances are configured to allow the detection member to be inserted into a more inner position than the first position when the respective terminals are inserted to the regular position.

According to another aspect of the present invention, in the connector, it is preferable that the terminal housing chambers are disposed along a circumferential direction around a center line along the axial direction, and the passage part extends along the center line.

According to still another aspect of the present invention, in the connector, it is preferable that the terminal housing chambers are disposed at regular intervals around the center line, the detection member has a contact part locked by the lances when the respective terminals are not inserted to the regular position, and a sectional shape of the contact part is regularly polygonal shape corresponding to number of the terminal housing chambers of the housing.

According to still another aspect of the present invention, in the connector, it is preferable that the housing has pillar parts extending along the passage part, both ends of the pillar part in an axial direction are supported, and the lances are integrally formed with the respective pillar parts.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following describes a connector according to an embodiment of the present invention in detail with reference to the accompanying drawings. This embodiment does not limit this invention. Components in the following embodiment include ones that those skilled in the art can easily think of and ones that are substantially the same.

Embodiment

Figure 1:
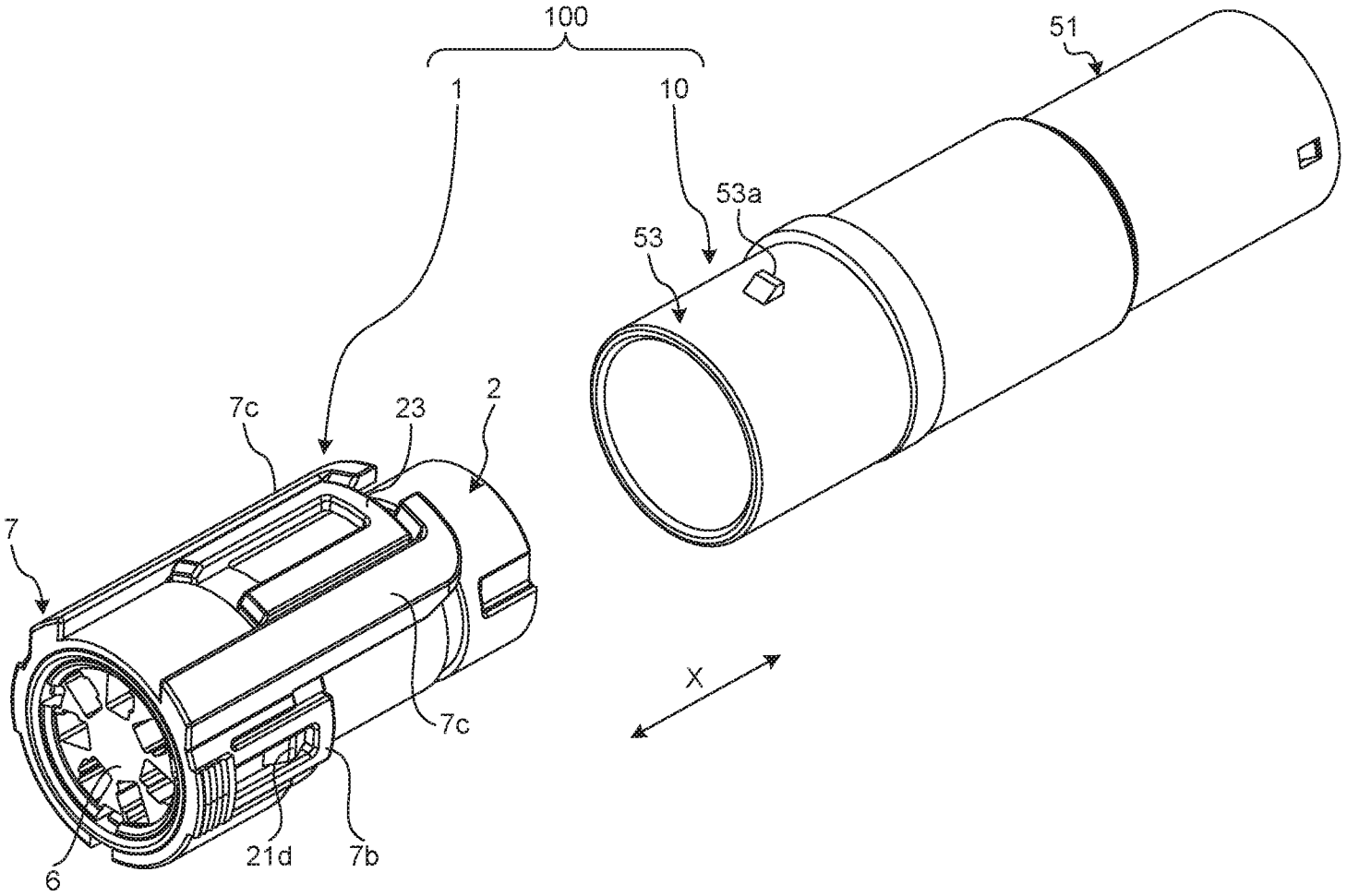
FIG. 1 is a perspective view of a connector unit of an embodiment.
Figure 2:
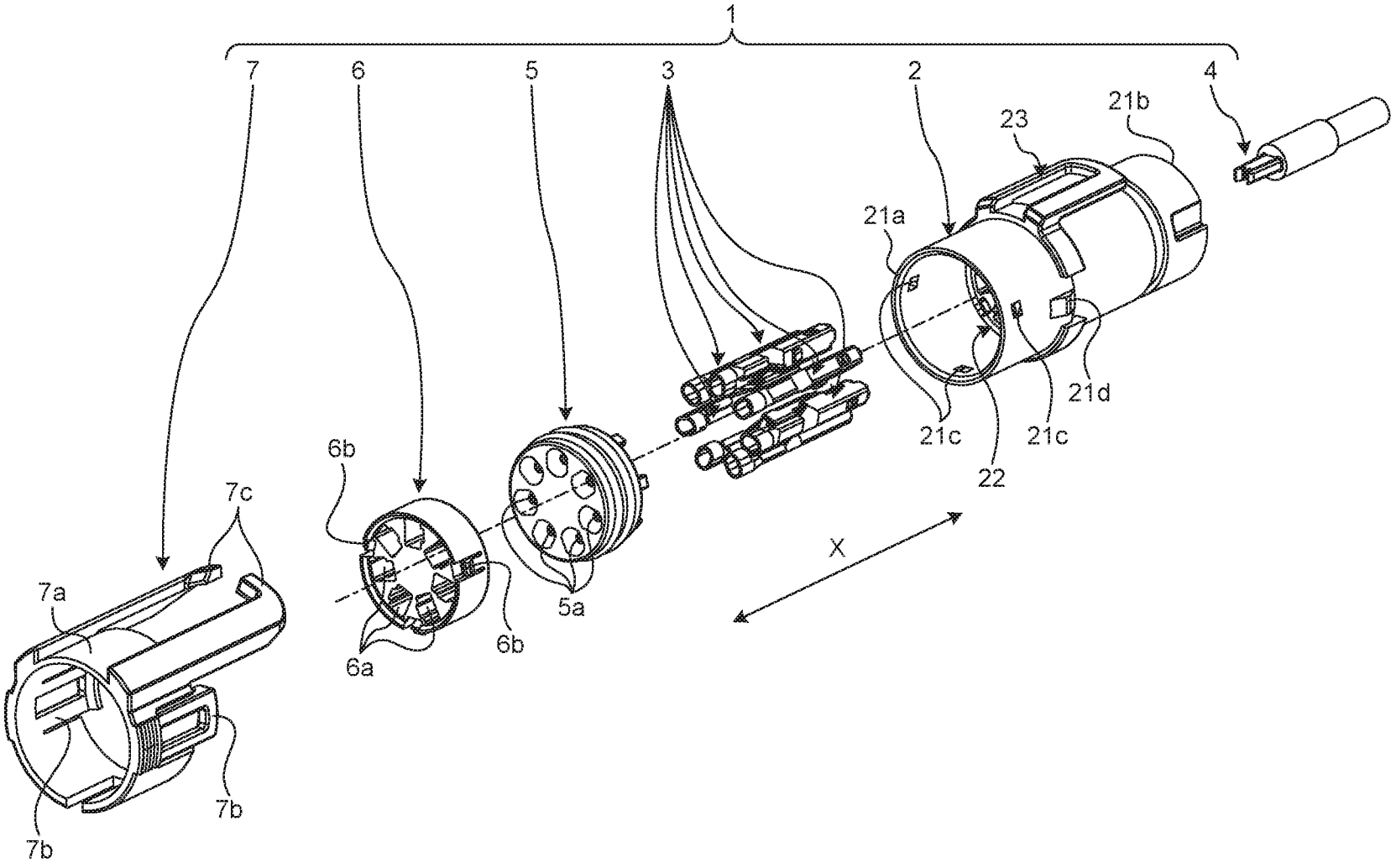
FIG. 2 is an exploded perspective view of a female connector according to the embodiment.
Figure 3:
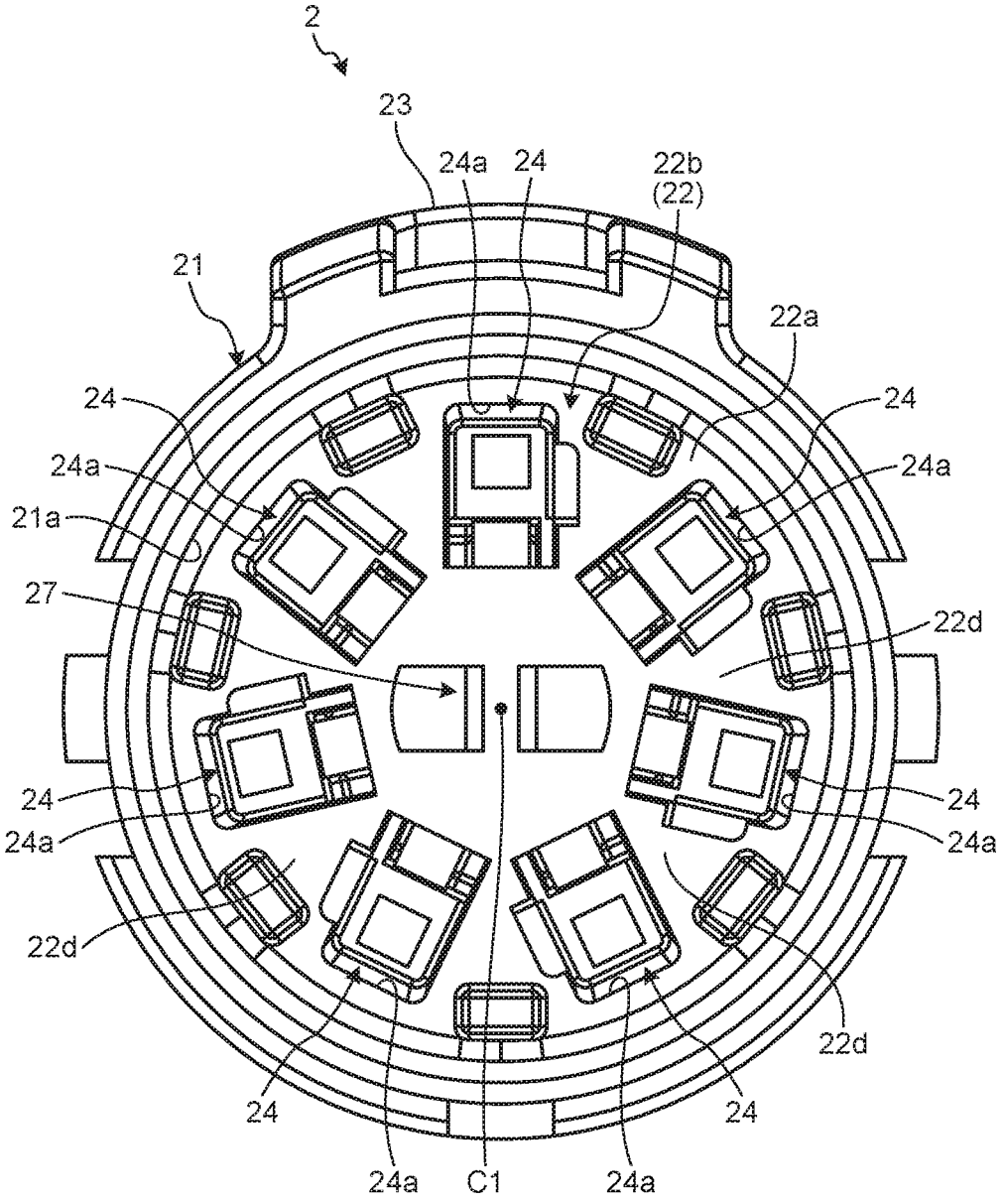
FIG. 3 is a back elevation of a housing according to the embodiment.
Figure 4:
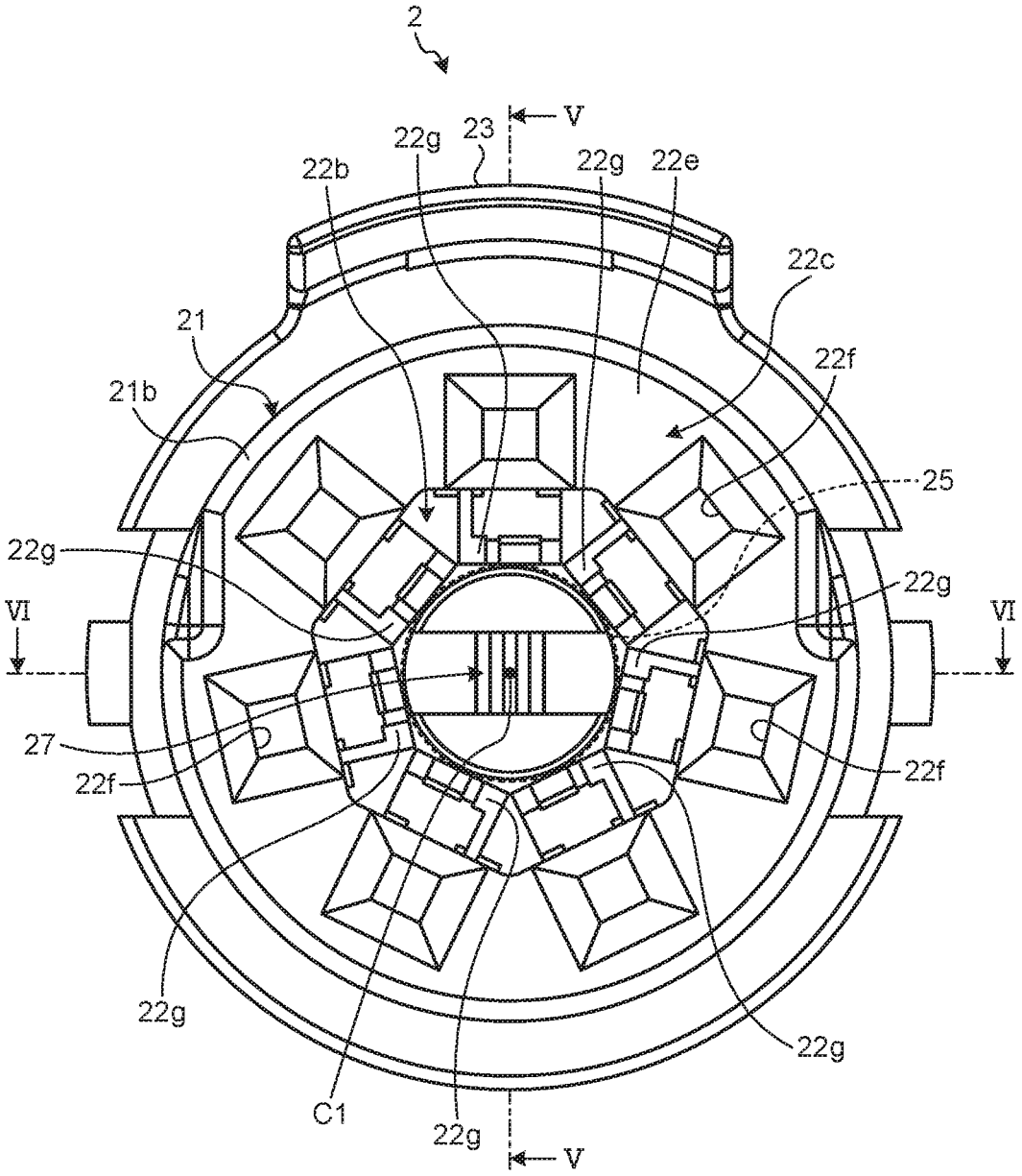
FIG. 4 is a front elevation of the housing according to the embodiment.
Figure 5:
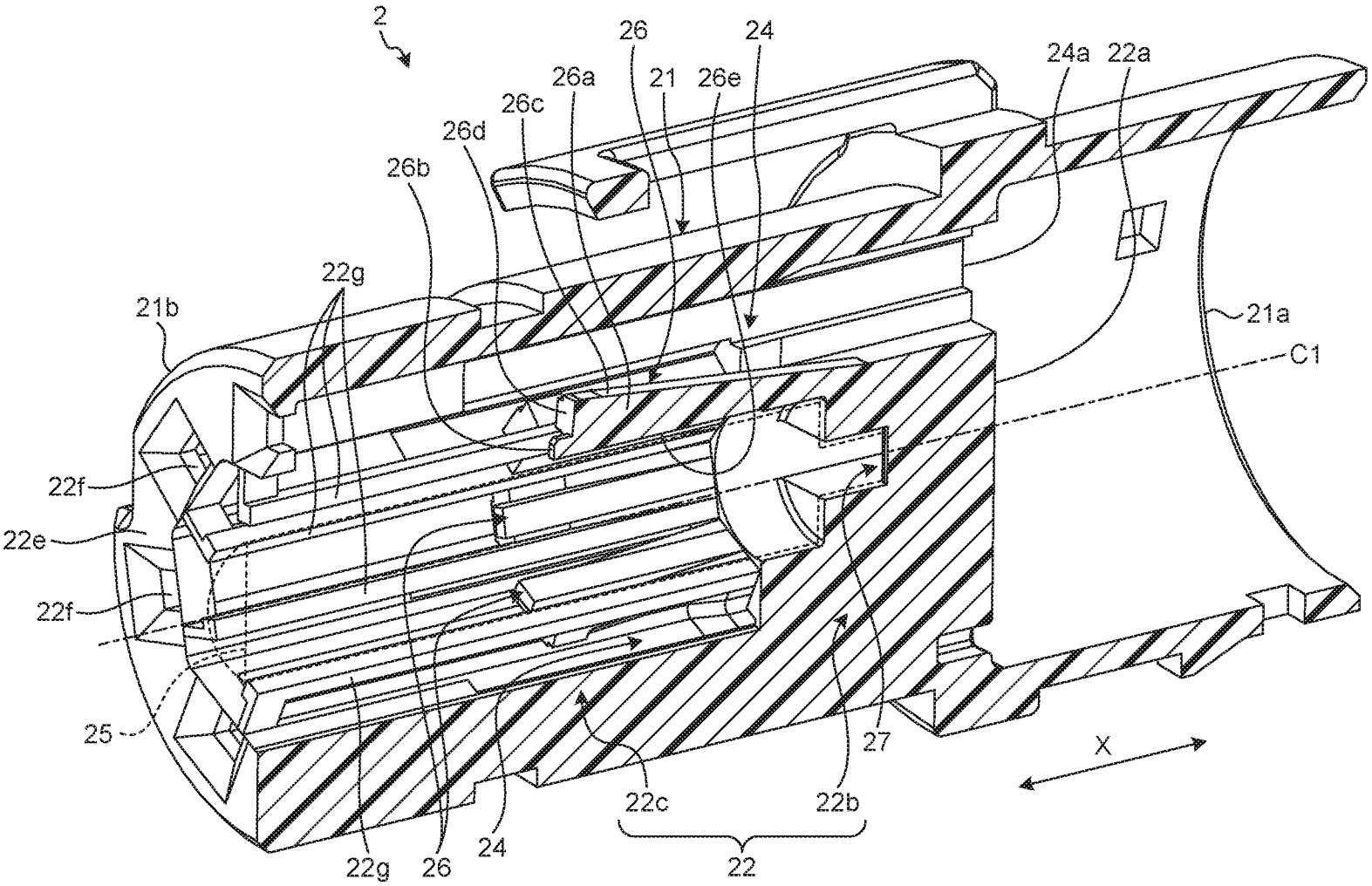
FIG. 5 is a sectional perspective view of the housing according to the embodiment.
Figure 6:
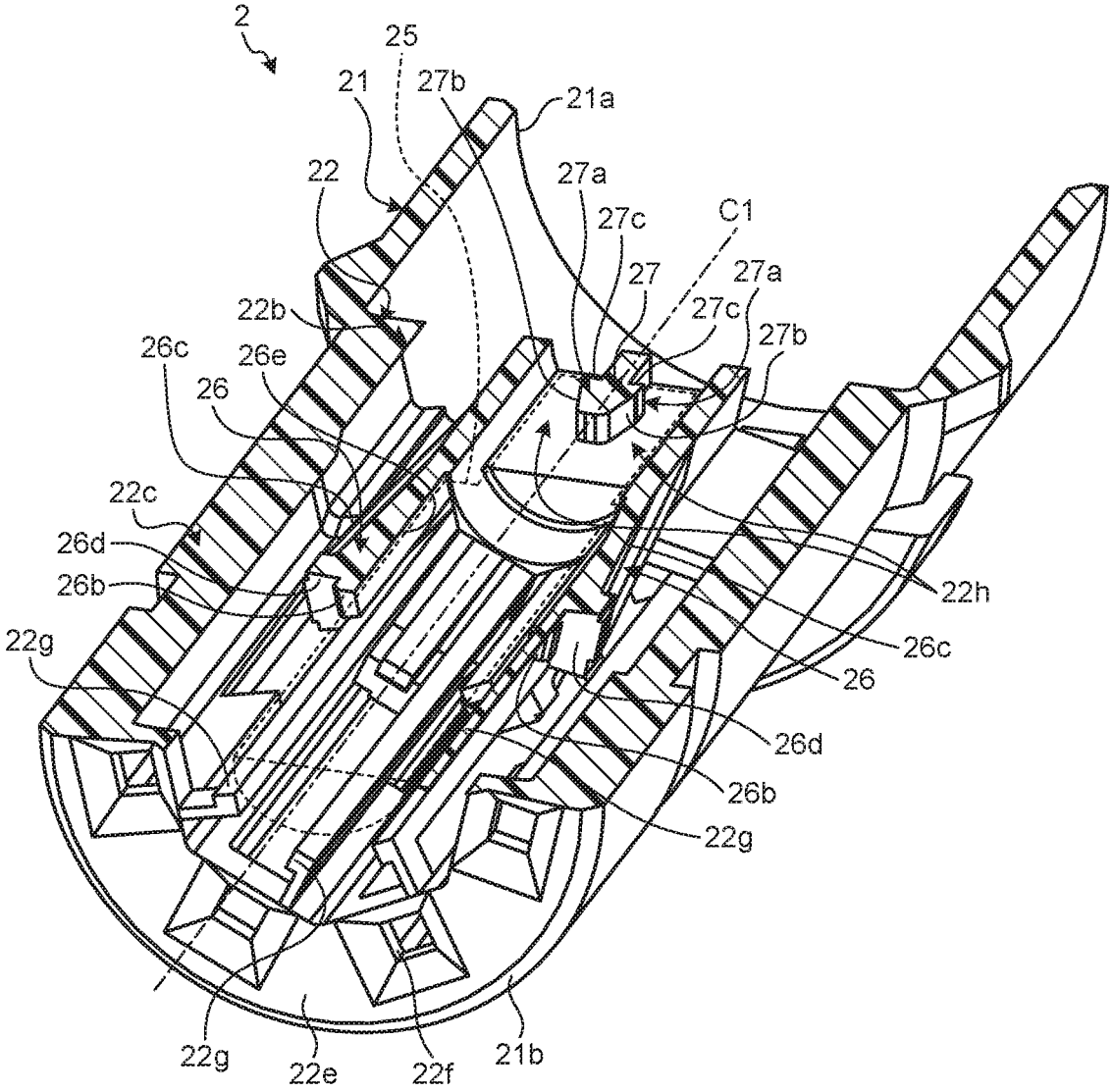
FIG. 6 is a sectional perspective view of the housing according to the embodiment.
Figure 7:
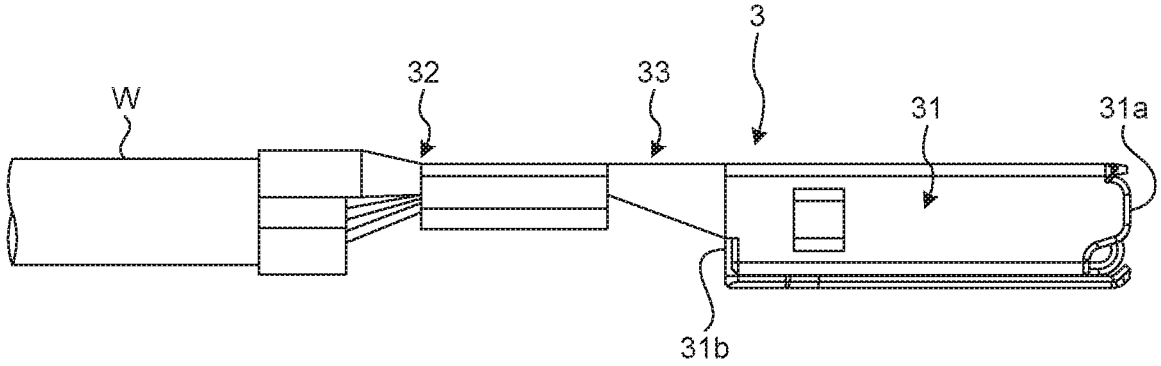
FIG. 7 is a side view of a female terminal according to the embodiment.
Figure 8:
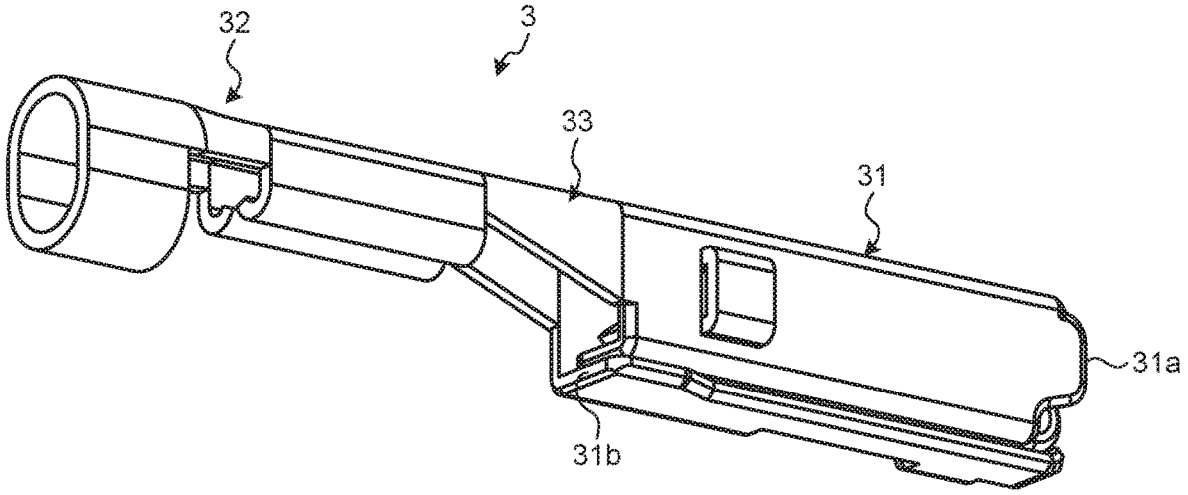
FIG. 8 is a perspective view of the female terminal according to the embodiment.
Figure 9:
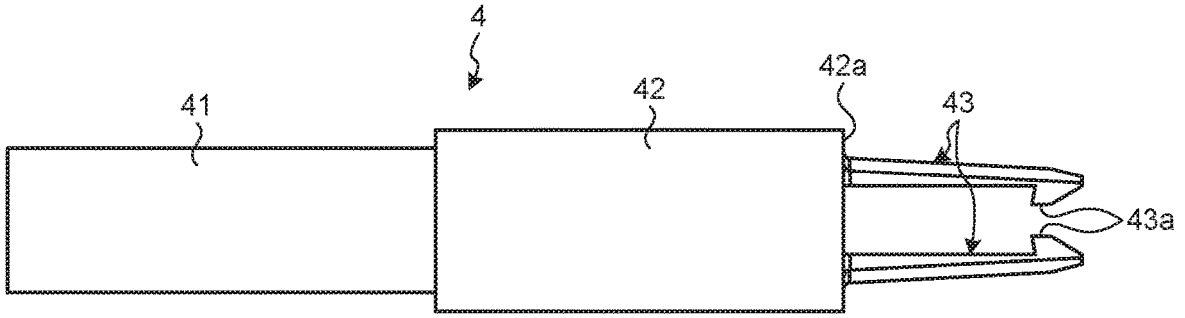
FIG. 9 is a plan view of a detection member according to the embodiment.
Figure 10:
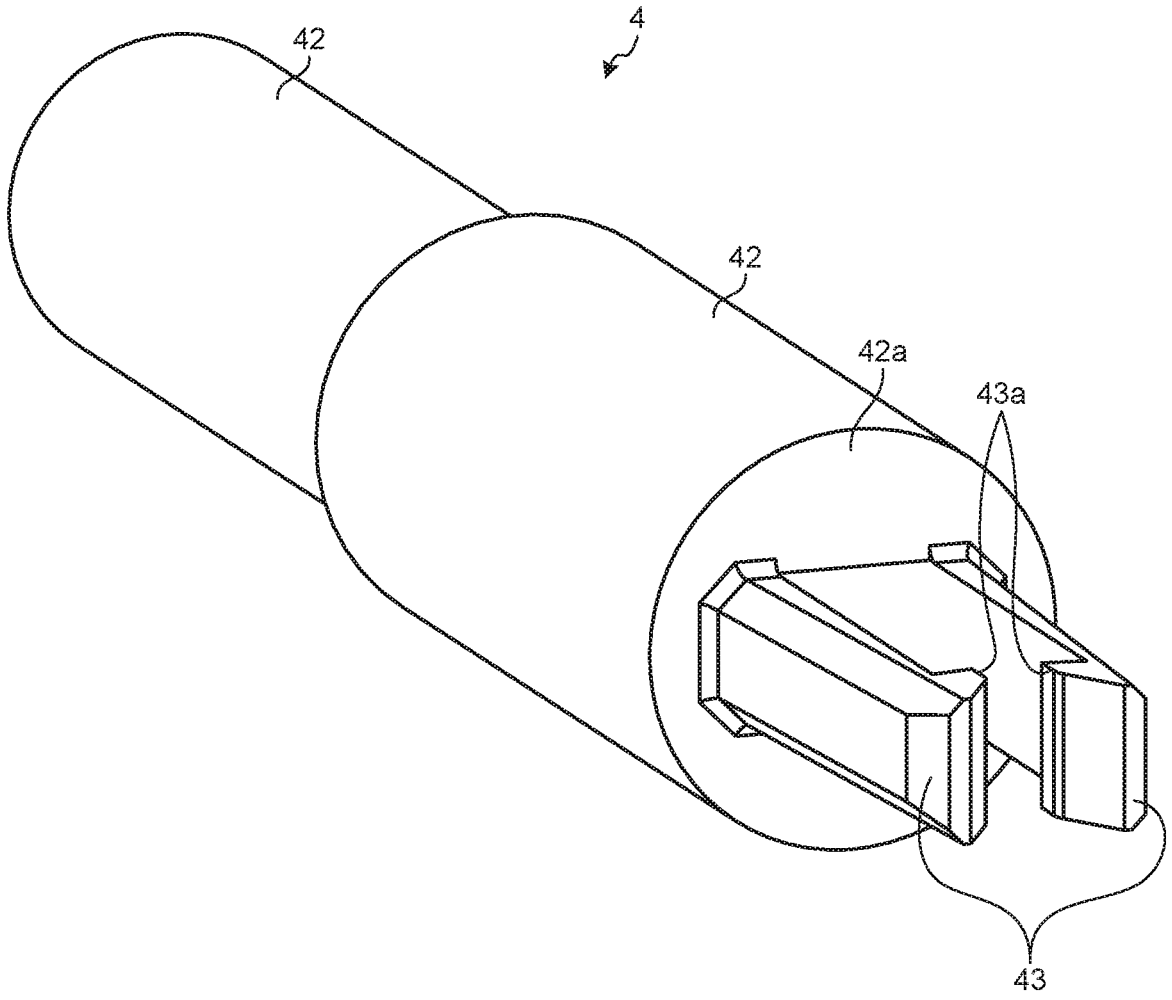
FIG. 10 is a perspective view of the detection member according to the embodiment.

The following describes an embodiment with reference to FIG. 1 to FIG. 19. The present embodiment relates to a connector. FIG. 1 is a perspective view of a connector unit of the embodiment; FIG. 2 is an exploded perspective view of a female connector according to the embodiment; FIG. 3 is a back elevation of a housing according to the embodiment; FIG. 4 is a front elevation of the housing according to the embodiment; FIG. 5 is a sectional perspective view of the housing according to the embodiment; FIG. 6 is a sectional perspective view of the housing according to the embodiment; FIG. 7 is a side view of a female terminal according to the embodiment; FIG. 8 is a perspective view of the female terminal according to the embodiment; FIG. 9 is a plan view of a detection member according to the embodiment; and FIG. 10 is a perspective view of the detection member according to the embodiment.

Figure 11:
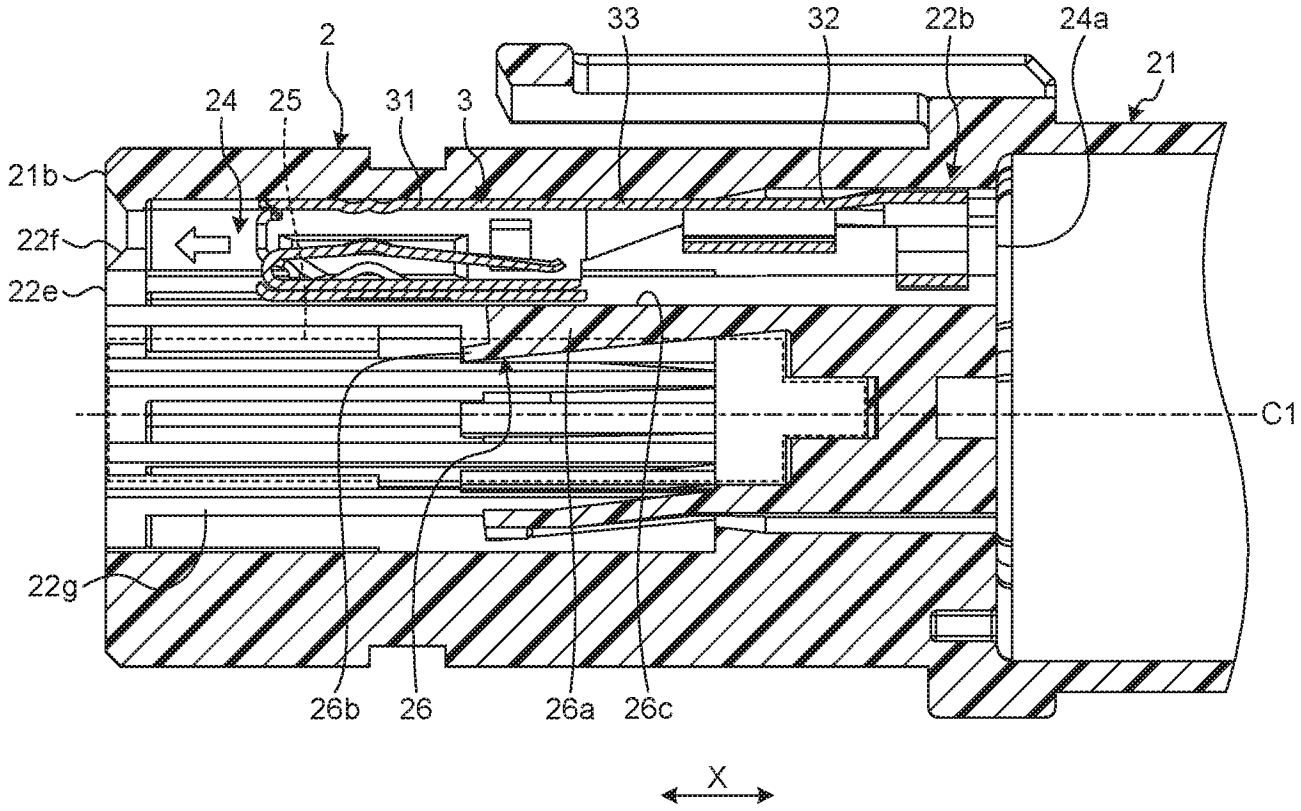
FIG. 11 is a sectional view of the female terminal being inserted into a terminal housing chamber.
Figure 12:
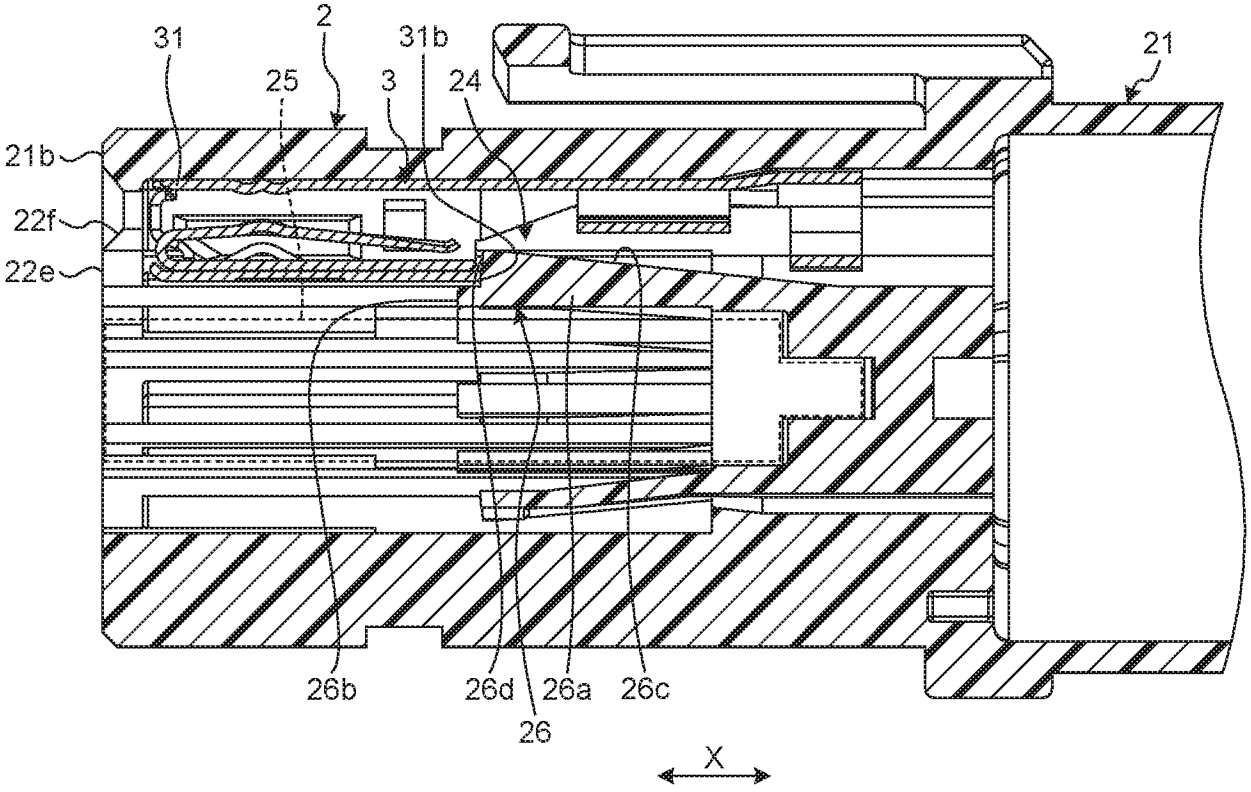
FIG. 12 is a sectional view of the female terminal that has been inserted to a regular position.
Figure 13:
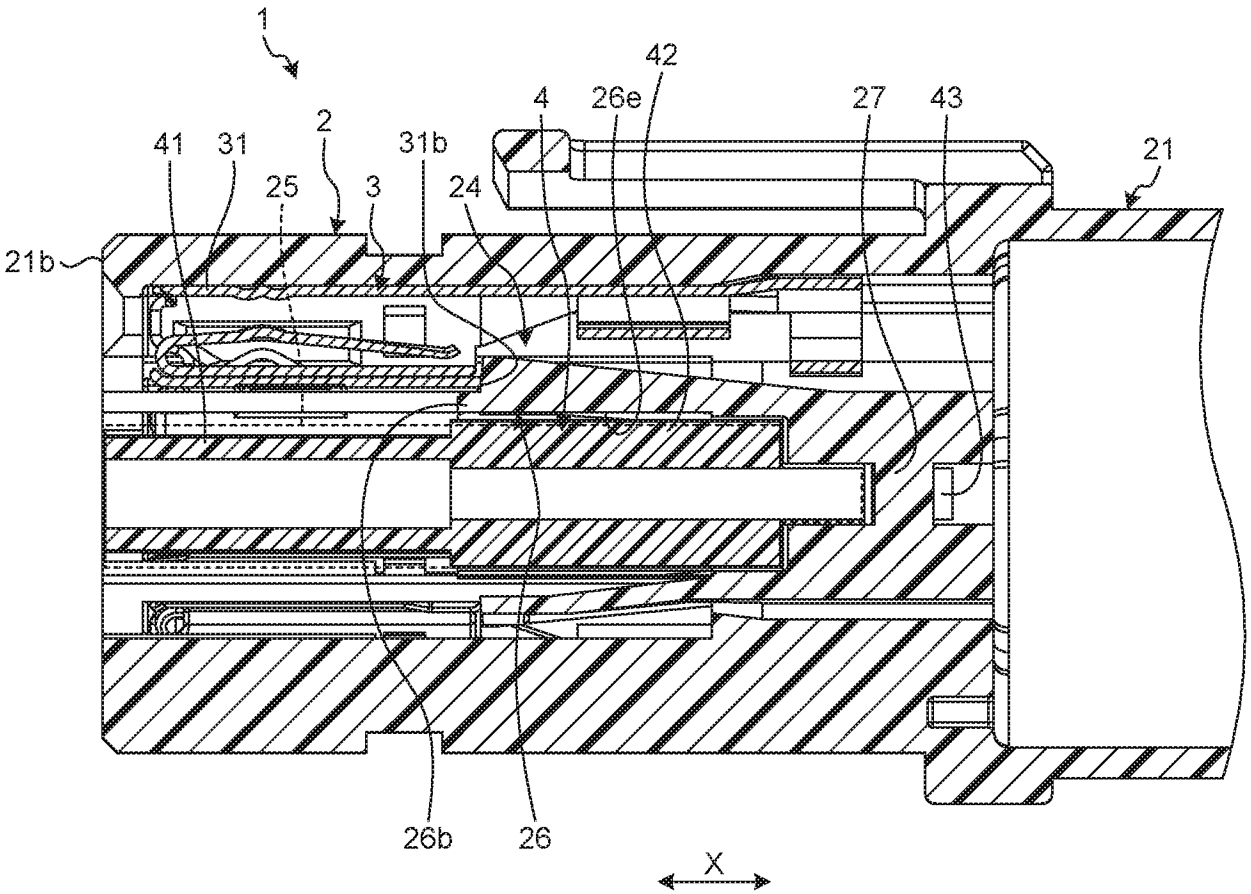
FIG. 13 is a sectional view of the detection member that has been inserted into the innermost part of a passage part.
Figure 14:
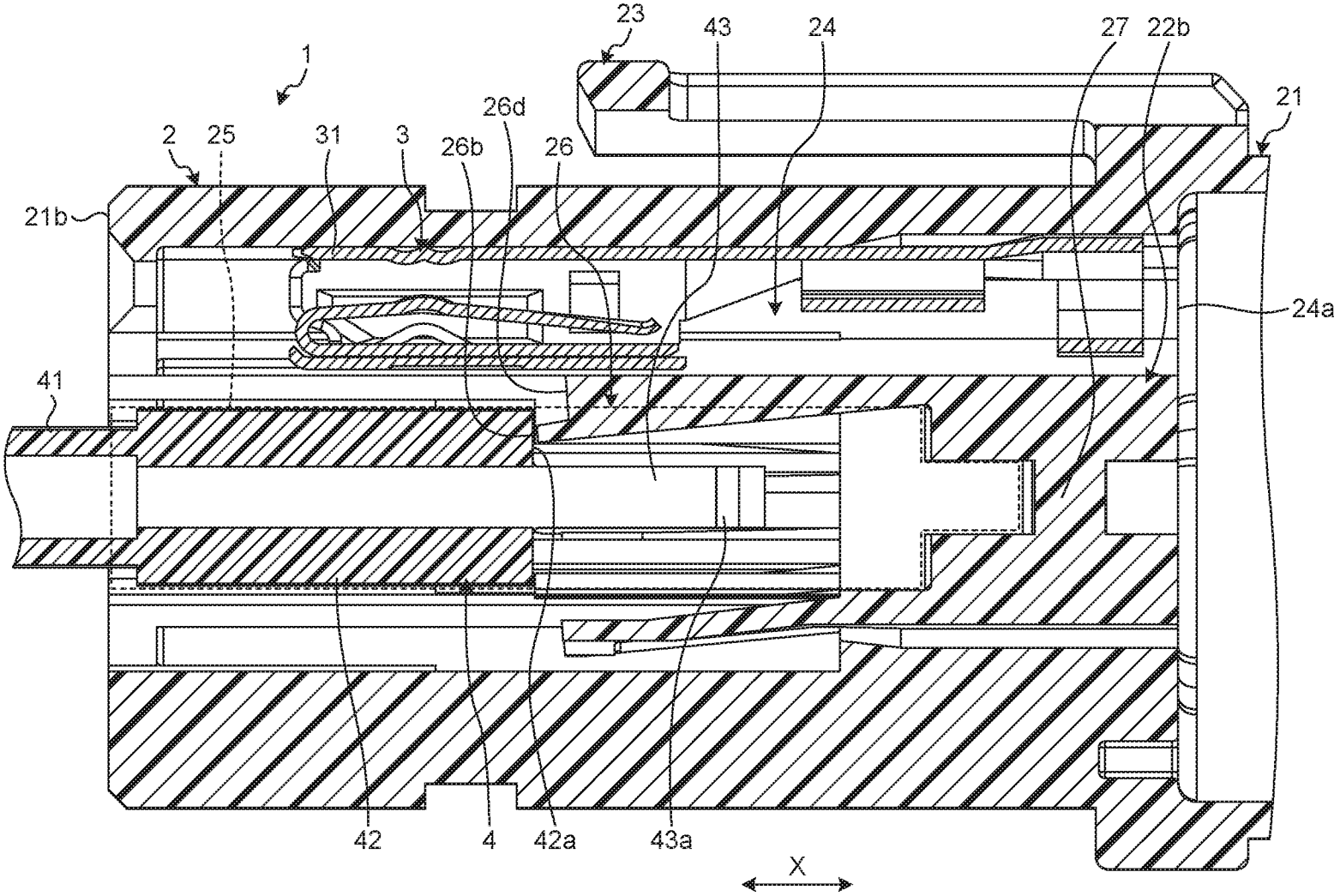
FIG. 14 is a sectional view of the detection member locked at a first position.

FIG. 11 is a sectional view of the female terminal being inserted into a terminal housing chamber; FIG. 12 is a sectional view of the female terminal that has been inserted to a regular position; FIG. 13 is a sectional view of the detection member that has been inserted into the innermost part of a passage part; and FIG. 14 is a sectional view of the detection member locked at a first position. FIG. 5 illustrates the V-V section of FIG. 4. FIG. 6 illustrates the VI-VI section of FIG. 4.

As illustrated in FIG. 1, a connector unit 100 according to the present embodiment has a female connector 1 and a male connector 10. The female connector 1 and the male connector 10 form a fitting connector pair. The female connector 1 and the male connector 10 of the present embodiment have detection members 4 and 14, respectively, detecting whether terminals are inserted to the regular position as described below.

As illustrated in FIG. 2, the female connector 1 has a housing 2, a plurality of female terminals 3, one detection member 4, a mat seal 5, a seal cover 6, and an unlock cover 7. The housing 2 has a cylindrical outer wall part 21 and a holding part 22. The outer wall part 21 and the holding part 22 are integrally molded of an insulating synthetic resin or the like. The outer wall part 21 is provided with a locking arm 23 locking the male connector 10.

In the following description of the female connector 1, an axial direction of the outer wall part 21 is referred to simply as an "axial direction X." The outer wall part 21 has a first opening 21*a*. The first opening 21*a* is an opening at one end of the outer wall part 21 in the axial direction X. The female terminals 3 are inserted from the first opening 21*a* and are held by the holding part 22.

The mat seal 5 is a cylindrical or disc-shaped seal member to be inserted into the outer wall part 21 from the first opening 21*a*. The mat seal 5 is formed of rubber or the like. The mat seal 5 has a plurality of holes 5*a* through which electric wires are passed. Electric wires to be connected to the female terminals 3 are passed through the holes 5*a*. The mat seal 5 prevents liquid from entering the inside of the housing 2.

The seal cover 6 is a cylindrical or disc-shaped member holding the mat seal 5. The seal cover 6 is molded of an insulting synthetic resin, for example. The seal cover 6 has a plurality of holes 6*a* through which electric wires are passed. A plurality of engaging parts 6*b* are provided on the periphery of the seal cover 6. The engaging parts 6*b* are locked by a plurality of respective locking holes 21*c* provided on the outer wall part 21 of the housing 2.

The unlock cover 7 is a cover member preventing misoperation of the locking arm 23. The unlock cover 7 is molded of an insulating synthetic resin, for example. The unlock cover 7 is mounted on the outside of the outer wall part 21 of the housing 2. The unlock cover 7 has a main body 7*a*, a plurality of engaging parts 7*b*, and a pair of protective arms 7*c*. The main body 7*a* is a part formed in a cylindrical shape and is engaged with the outer wall part 21. The engaging parts 7*b* are provided on the main body 7*a* and have flexibility. The engaging parts 7*b* are engaged with a plurality of respective locking protrusions 21*d* provided on the outer wall part 21 of the housing 2.

The protective arms 7*c* protrude along the axial direction X from the main body 7*a*. As illustrated in FIG. 1, when the unlock cover 7 is mounted on the housing 2, the pair of protective arms 7*c* surround the locking arm 23. The protective arms 7*c* prevent the occurrence of unintentional unlocking caused by interference of other components with the locking arm 23.

The following describes details of the housing 2 with reference to FIG. 3 to FIG. 6. The holding part 22 is disposed inside the outer wall part 21. As illustrated in FIG. 5 and the like, the holding part 22 has a core part 22*b* and a tubular part 22*c*. The core part 22*b* is a substantially disc-shaped part and is positioned at an end of the holding part 22 closer to the first opening 21*a*. The tubular part 22*c* is a substantially tubular part and extends from the core part 22*b* to a tip 21*b* of the outer wall part 21. The tip 21*b* is an end to fit to the male connector 10.

The holding part 22 has a plurality of terminal housing chambers 24. A terminal housing chamber 24 has a terminal insertion port 24*a* opening toward the first opening 21*a*. The terminal insertion port 24*a* opens in an end face 22*a* of the core part 22*b*. The end face 22*a* is an end face of the core part 22*b* on one side in the axial direction X and is directed toward the first opening 21*a*. The terminal housing chambers 24 extend along the axial direction X from the terminal insertion port 24*a*. The terminal housing chambers 24 are formed across the core part 22*b* and the tubular part 22*c*.

In the present embodiment, as illustrated in FIG. 3 and the like, the terminal housing chambers 24 are disposed along a circumferential direction. More specifically, the terminal housing chambers 24 are disposed at regular intervals along the circumferential direction around a center line C1. The center line C1 is a line along the axial direction X and is a central axial line of the holding part 22, for example. The housing 2 of the present embodiment has seven terminal housing chambers 24 disposed at regular intervals. The core part 22*b* has radial partitioning walls 22*d* each partitioning adjacent terminal housing chambers 24 from each other.

As illustrated in FIG. 4 and FIG. 5, a male terminal insertion port 22*f* is provided in an end face 22*e* of the tubular part 22*c*. One male terminal insertion port 22*f* is disposed for one terminal housing chamber 24. A tab 13*a* of a male terminal 13 is inserted into the terminal housing chamber 24 from the male terminal insertion port 22*f* to be connected to a female terminal 3.

As illustrated in FIG. 5 and the like, the housing 2 has a passage part 25. The passage part 25 is a hollow part of the tubular part 22*c* and is a passage-shaped space part into which the detection member 4 is inserted. The passage part 25 extends along the center line C1 and is provided concentrically with the center line C1, for example. The shape of the passage part 25 of the present embodiment is substantially cylindrical. The passage part 25 opens toward a side of the tip 21*b*. The passage part 25 is adjacent to each of the terminal housing chambers 24 in a radial direction. In other words, the terminal housing chambers 24 are disposed along the circumferential direction so as to surround the passage part 25. The detection member 4 is inserted into the passage part 25 from a side of the tip 21*b*. That is to say, the direction in which the detection member 4 is inserted into the passage part 25 and the direction in which the female terminal 3 is inserted into the terminal housing chamber 24 are opposite to each other.

As illustrated in FIG. 4 and the like, the passage part 25 of the present embodiment is surrounded by a plurality of pillar parts 22*g*. A pillar part 22*g* is a pillar-shaped part extending along the axial direction X and is positioned at a boundary between the terminal housing chamber 24 and the passage part 25. One end of the pillar part 22*g* is connected to the end face 22*e* of the tubular part 22*c*, whereas the other end of the pillar part 22*g* is connected to the core part 22*b*. That is to say, the pillar part 22*g* is a double-end supported beam supported at both ends in the axial direction X.

As illustrated in FIG. 5 and FIG. 6, the holding part 22 has a plurality of lances 26. When the female terminal 3 is inserted to the regular position in the terminal housing chamber 24, a lance 26 is engaged with the female terminal 3 to lock the female terminal 3. The holding part 22 has one lance 26 for one terminal housing chamber 24. The lances 26 protrude along the axial direction X from the core part 22*b* toward the tip 21*b*. In the housing 2 of the present embodiment, the pillar part 22*g* and the lance 26 are integrally formed. In other words, part of the pillar part 22*g* functions as the lance 26.

The lance 26 is positioned at the boundary between the terminal housing chamber 24 and the passage part 25. In other words, the lance 26 is provided so as to partition the terminal housing chamber 24 and the passage part 25 from each other. The lance 26 has a main body 26*a* and a locking protrusion 26*b*. The main body 26*a* is a part integral with the pillar part 22*g*. The main body 26*a* has an inclined face 26*c* and a locking face 26*d*.

The inclined face 26*c* is a face directed toward the terminal housing chamber 24 and is inclined relative to the axial direction X. More specifically, the inclined face 26*c* is inclined so as to be closer to the outer wall part 21 as the distance to the tip 21*b* decreases along the axial direction X. The locking face 26*d* is a face locking the female terminal 3. The locking face 26*d* is directed toward the tip 21*b*. The lance 26 has an inner face 26*e*. The inner face 26*e* is a plane directed toward the passage part 25, or in other words, a face facing the center line C1 in the radial direction. The inner face 26*e* is parallel to the axial direction X with the lance 26 without bending.

The locking protrusion 26*b* protrudes along the axial direction X from the main body 26*a* and separates from the pillar part 22*g*. A gap is provided between the locking protrusion 26*b* and the pillar part 22*g*. The locking protrusion 26*b* protrudes toward the tip 21*b* from a radially inner end of the locking face 26*d*.

As illustrated in FIG. 6 and the like, the core part 22*b* has an engaging part 27. The engaging part 27 is a part engaged with the detection member 4 to lock the detection member 4. The engaging part 27 is positioned at the innermost part of the passage part 25 when viewed from the tip 21*b*. The engaging part 27 is disposed concentrically with the center line C1. In the core part 22*b*, a space part 22*h* is provided beside the engaging part 27.

The engaging part 27 has a pair of protrusions 27*a*. The pair of protrusions 27*a* protrude in opposite directions. A protrusion 27*a* has an inclined face 27*b* and a locking face 27*c*. The inclined face 27*b* is inclined relative to the axial direction X so as to depart from the center line C1 as the distance to the first opening 21*a* decreases along the axial direction X. The locking face 27*c* is a face directed toward the first opening 21*a*.

As illustrated in FIG. 7 and FIG. 8, the female terminal 3 has a terminal connection part 31, an electric wire connection part 32, and an intermediate part 33. The female terminal 3 is formed of metal having conductivity such as copper. The terminal connection part 31 is a part to be electrically connected to the male terminal 13 and has a rectangular tubular shape. The tab 13*a* of the male terminal 13 is inserted into the terminal connection part 31 from a tip 31*a* of the terminal connection part 31 to be electrically connected to the terminal connection part 31. The electric wire connection part 32 is a part to be connected to an electric wire W. The electric wire connection part 32 is crimped onto a core and a clad of the electric wire W. In FIG. 8 and the subsequent drawings, illustration of the electric wire W is omitted. The intermediate part 33 is a part connecting a rear end 31*b* of the terminal connection part 31 and the electric wire connection part 32 to each other.

As illustrated in FIG. 9 and FIG. 10, the detection member 4 has a shaft part 41, a contact part 42, and a pair of engaging parts 43 and 43. The detection member 4 is molded of an insulating synthetic resin, for example. The shaft part 41 is a part formed in a tubular or rod-like shape. The shaft part 41 is a part held by an operator when the detection member 4 is inserted into the passage part 25. The shape of the shaft part 41 of the present embodiment is cylindrical.

The contact part 42 is a part being in contact with the lance 26 when the female terminal 3 is in a semi-insertion state. The shape of the contact part 42 is tubular shape or rod-like shape, for example. The sectional shape of the contact part 42 of the present embodiment is circular shape. The contact part 42 may be formed in a hollow. The shaft part 41 is connected to one end of the contact part 42 in the axial direction. The contact part 42 has a contact face 42*a*. The contact face 42*a* is an end face on the side opposite to the side to which the shaft part 41 is connected. The shape of the contact face 42*a* is circular shape.

The pair of engaging parts 43 and 43 protrude in the axial direction from the contact face 42*a*. The engaging parts 43 are formed in an arm shape having flexibility. A hook part 43*a* is provided at the tip of an engaging part 43. Two hook parts 43*a* face each other in a direction orthogonal to the axial direction X. The detection member 4 is engaged with the engaging part 27 of the housing 2 with the pair of engaging parts 43 and 43. The pair of engaging parts 43 and 43 of the present embodiment have a shape symmetrical about a central axial line of the detection member 4. Consequently, work to engage the detection member 4 with the engaging part 27 of the housing 2 is easy.

As illustrated in FIG. 11, the female terminal 3 is inserted into the terminal housing chamber 24 from the terminal insertion port 24*a*. The terminal connection part 31 of the female terminal 3 presses the lance 26 toward the center line C1. The lance 26 bends to allow the terminal connection part 31 to advance toward the tip 21*b*. In this process, the locking protrusion 26*b* of the lance 26 protrudes to the passage part 25. The passage part 25 has enough wideness to enable the lance 26 to bend without interfering with the pillar parts 22*g* and the other lances 26. That is to say, the passage part 25 is a movable range of the lance 26 when the female terminal 3 is inserted into the terminal housing chamber 24.

When the female terminal 3 further advances toward the tip 21*b*, as illustrated in FIG. 12, the terminal connection part 31 climbs over the inclined face 26*c* of the lance 26. Thus, the rear end 31*b* of the terminal connection part 31 is positioned closer to the tip 21*b* than the locking face 26*d* of the lance 26 is. The position of the female terminal 3 illustrated in FIG. 12 is referred to as a "regular position." The regular position of the female terminal 3 is a position at which the rear end 31*b* of the terminal connection part 31 is closer to the tip 21*b* than the locking face 26*d* is and is, in other words, a position at which the rear end 31*b* is locked by the locking face 26*d*.

When the female terminal 3 is inserted to the regular position, the lance 26 moves to an area outside the passage part 25 through an elastic restoration force of the lance 26. The locking face 26*d* of the lance 26 faces the rear end 31*b* of the terminal connection part 31 in the axial direction X. The locking face 26*d* prevents the female terminal 3 from moving in a removing direction out of the terminal housing chamber 24.

After all the female terminals 3 are inserted into the terminal housing chambers 24, the detection member 4 is inserted into the passage part 25. When the female terminal 3 is inserted to the regular position in the terminal housing chamber 24, the lance 26 is positioned outside the passage part 25 and does not interfere with the detection member 4. Consequently, the detection member 4 advances to the inner part of the passage part 25 along the inner face 26*e* of the lance 26 to be housed in the passage part 25. When the detection member 4 is inserted into the innermost part of the passage part 25, as illustrated in FIG. 13, the engaging parts 43 are engaged with the engaging part 27 of the housing 2. In the following description, for the detection member 4, a position at which the engaging parts 43 are engaged with the engaging part 27 of the housing 2 is referred to as an "insertion completion position."

The engaging parts 43 are engaged with the engaging part 27 of the housing 2, whereby the detection member 4 is fixed. The contact part 42 of the detection member 4 supports the lance 26 from the inside in a radial direction. The contact part 42 prevents the lance 26 from bending radially inward. That is to say, a lock state, in which the lance 26 prevents the female terminal 3 from moving, is maintained by the contact part 42.

FIG. 14 illustrates the detection member 4 locked at the first position. The female terminal 3 is in the semi-insertion state, in which the female terminal 3 is not fully inserted to the regular position in the terminal housing chamber 24. The female terminal 3 in the semi-insertion state presses the lance 26 toward the passage part 25 to bend the lance 26. The locking protrusion 26*b* of the lance 26 protrudes to the passage part 25. The locking protrusion 26*b* is in contact with the contact face 42*a* of the detection member 4 to lock the detection member 4 at the first position. The first position is a position closer to an entrance of the passage part 25 than the insertion completion position is. When the detection member 4 is locked at the first position, the shaft part 41 of the detection member 4 protrudes from the passage part 25. The detection member 4 is locked with the shaft part 41 protruding from the passage part 25, thereby allowing the operator to recognize that the female terminal 3 is in the semi-insertion state.

In the female connector 1 of the present embodiment, when at least one female terminal 3 is in the semi-insertion state, the detection member 4 is locked at the first position by the lance 26. In other words, the detection member 4 of the present embodiment can detect semi-insertion of all the female terminals 3 by one contact part 42. There is no need to provide individual contact parts 42 for the female terminals 3, and thus the contact part 42 can be reduced in size while ensuring the necessary strength of the contact part 42. The lance 26 allows the detection member 4 to be inserted into a more inner position than the first position when the female terminal 3 is inserted into the regular position. The detection member 4 is inserted into the innermost part of the passage part 25 without being locked at the first position, thereby allowing the operator to recognize that there are no female terminals 3 in the semi-insertion state.

Figure 15:
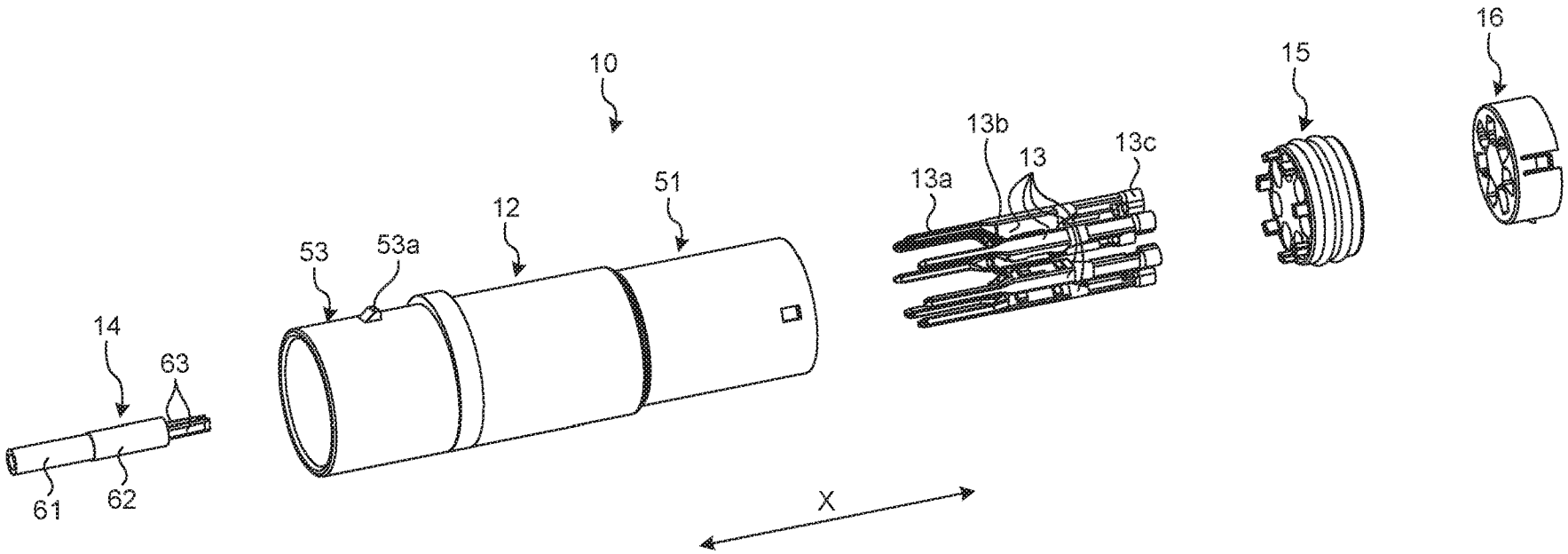
FIG. 15 is an exploded perspective view of a male connector according to the embodiment.
Figure 16:
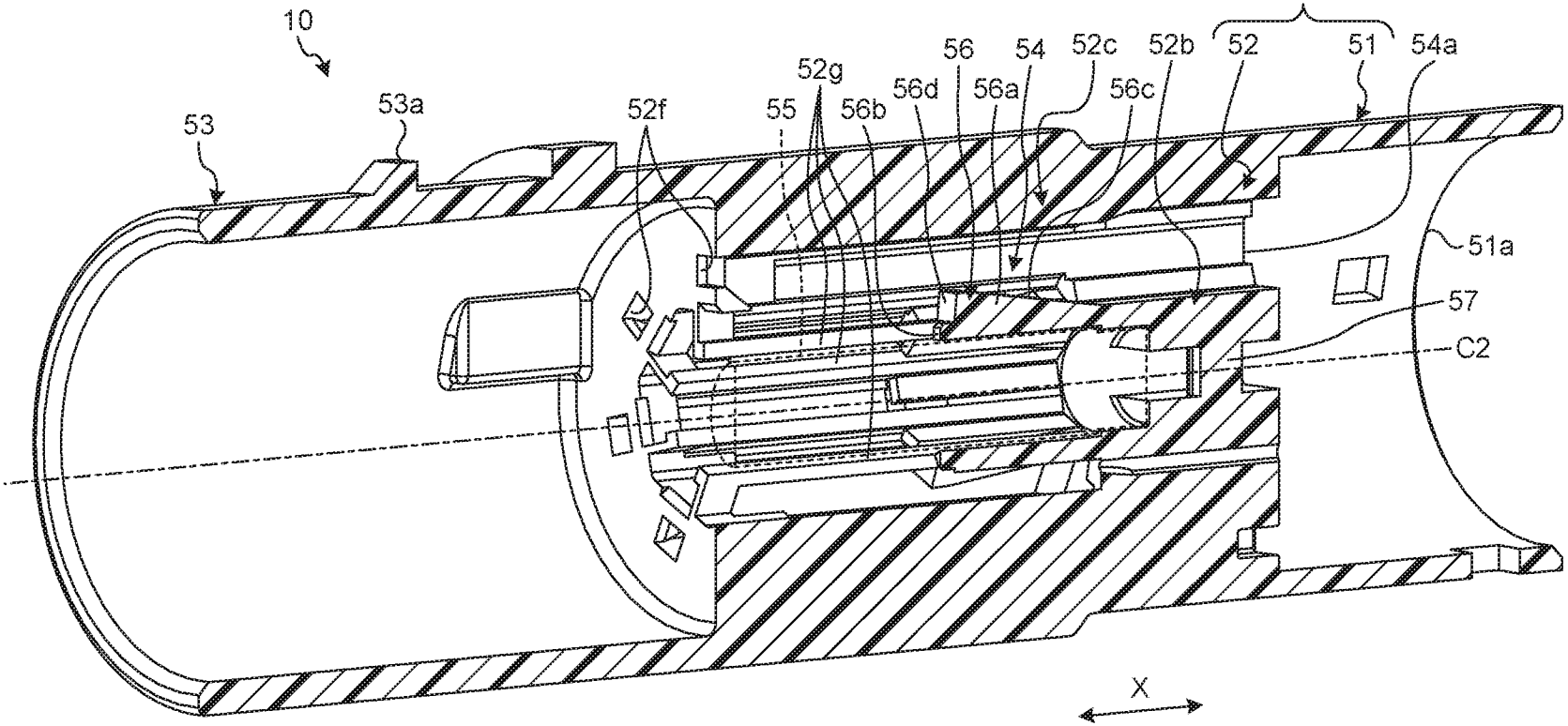
FIG. 16 is an exploded perspective view of the housing according to the embodiment.

The following briefly describes the male connector 10 with reference to FIG. 15 and FIG. 16. In the male connector 10, the configuration to detect terminal's semi-insertion is similar to the configuration of the female connector 1. As illustrated in FIG. 15, the male connector 10 has a housing 12, a plurality of male terminals 13, one detection member 14, a mat seal 15, and a seal cover 16. The male connector 10 has the same number of male terminals 13 as the number of female terminals 3, for example.

As illustrated in FIG. 16, the housing 12 of the male connector 10 has a tubular outer wall part 51 and a holding part 52. The outer wall part 51 and the holding part 52 are integrally molded of an insulating synthetic resin or the like. The outer wall part 51 has a fitting part 53 to be fit to the housing 2 of the female connector 1. A protrusion 53*a* to be locked by the locking arm 23 of the female connector 1 is provided on an outer circumferential face of the fitting part 53. The outer wall part 51 has a first opening 51*a* into which the mat seal 15 is inserted. The seal cover 16 is fixed to the first opening 51*a*.

The holding part 52 has a core part 52*b* and a tubular part 52*c*. The holding part 52 has a plurality of terminal housing chambers 54. A terminal housing chamber 54 has a terminal insertion port 54*a* opening toward the first opening 51*a*. The terminal housing chambers 54 extend along the axial direction X from the terminal insertion port 54*a*. The terminal housing chambers 54 are formed across the core part 52*b* and the tubular part 52*c*.

The terminal housing chambers 54 are disposed at regular intervals along the circumferential direction around a center line C2. The center line C2 is a line along the axial direction X and is a central axial line of the holding part 52, for example. Tab through holes 52*f* are provided in an end face of the tubular part 52*c*. The tab 13*a* of the male terminal 13 protrudes inside the fitting part 53 via a tab through hole 52*f*.

The housing 12 has a passage part 55. The passage part 55 is a hollow part of the tubular part 52*c*, into which the detection member 14 is inserted. The passage part 55 opens toward the fitting part 53. That is to say, the direction in which the detection member 14 is inserted into the passage part 55 and the direction in which the male terminal 13 is inserted into the terminal housing chamber 54 are opposite to each other. The passage part 55 is surrounded by a plurality of pillar parts 52*g*.

The holding part 52 has a plurality of lances 56. When the male terminal 13 is inserted to the regular position in the terminal housing chamber 54, a lance 56 is engaged with the male terminal 13 to lock the male terminal 13. The lances 56 protrude along the axial direction X from the core part 52*b* toward the fitting part 53. The lance 56 is integral with a pillar part 52*g*. The lance 56 is positioned at a boundary between the terminal housing chamber 54 and the passage part 55.

The lance 56 has a main body 56*a* and a locking protrusion 56*b*. The main body 56*a* has an inclined face 56*c* and a locking face 56*d*. The shape and function of the lance 56 are similar to the shape and function of the lance 26 of the female connector 1. The core part 52*b* is provided with an engaging part 57. The position, shape, and function of the engaging part 57 are similar to the position, shape, and function of the engaging part 27 of the female connector 1.

Figure 17:
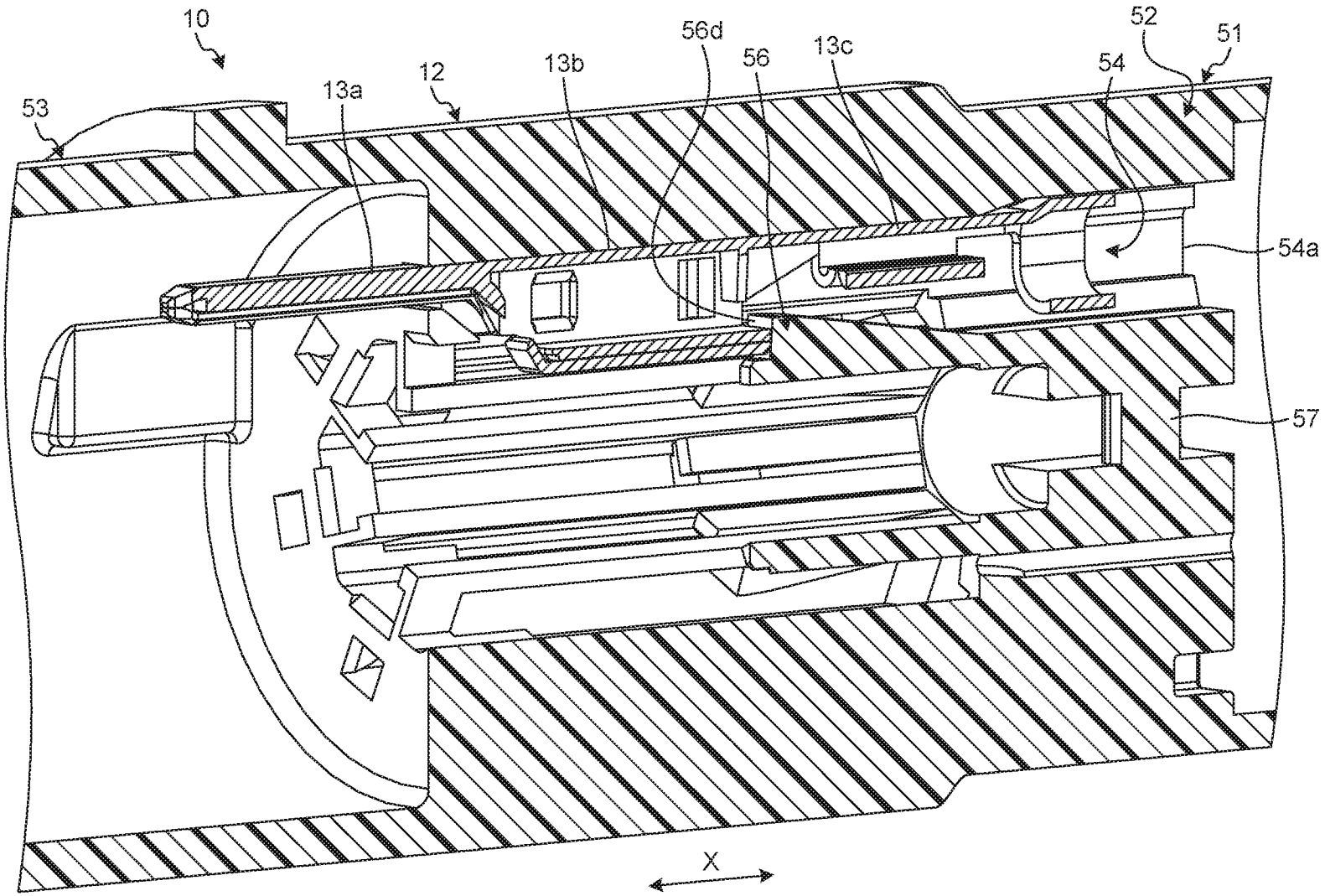
FIG. 17 is a sectional perspective view of a male terminal that has been inserted to the regular position.

FIG. 17 illustrates the male terminal 13 that has been inserted to the regular position in the terminal housing chamber 54. The male terminal 13 has the tab 13*a*, a tubular part 13*b*, and an electric wire connection part 13*c*. The tubular part 13*b* is formed in a tubular shape and is positioned between the tab 13*a* and the electric wire connection part 13*c*. The electric wire connection part 13*c* is a part to be crimped to the electric wire W. The tab 13*a* is a part to be electrically connected to the female terminal 3 and protrudes along the axial direction X from the tubular part 13*b*. When the male terminal 13 is inserted to the regular position, the locking face 56*d* of the lance 56 locks the tubular part 13*b*.

Figure 18:
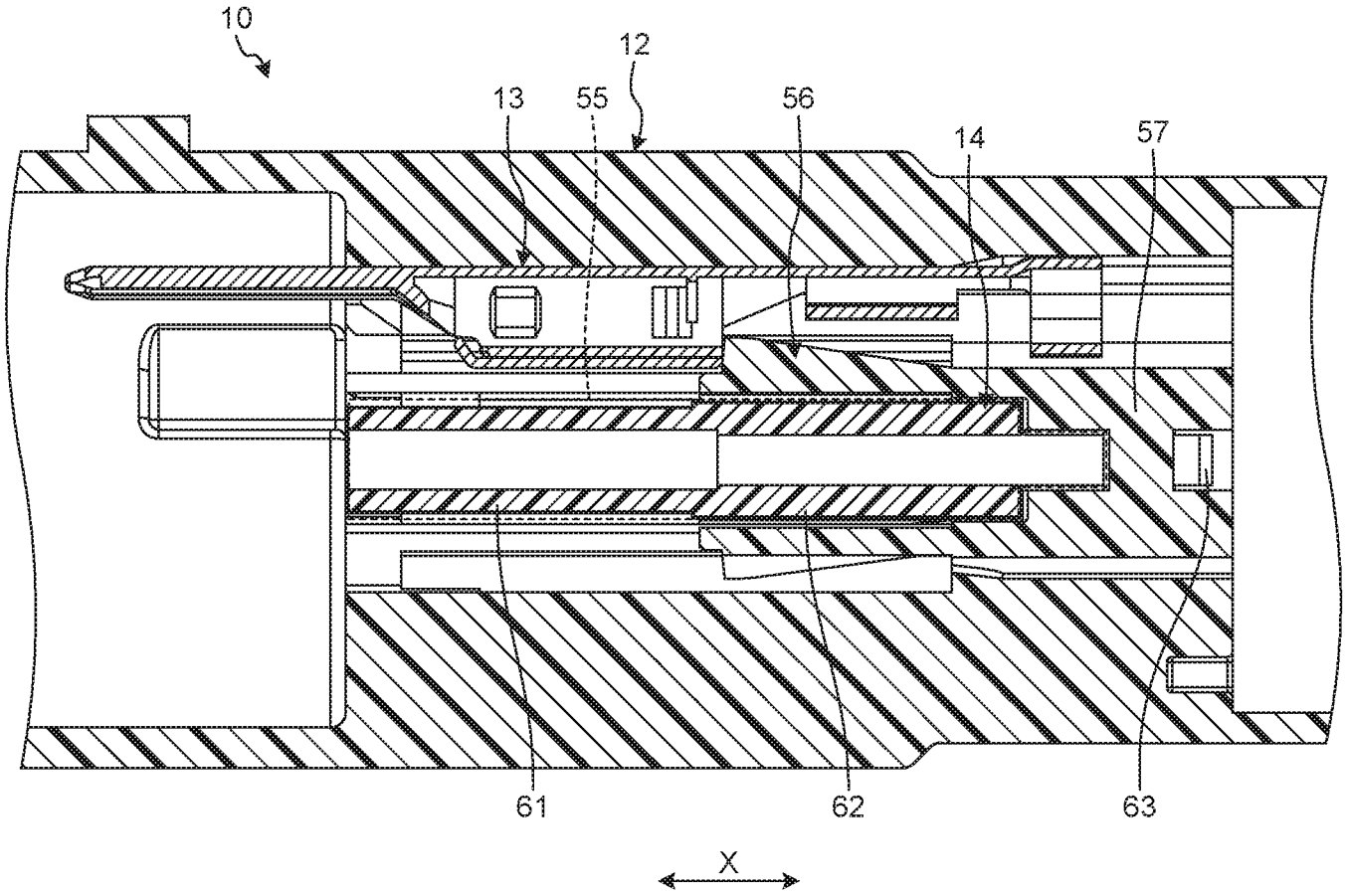
FIG. 18 is a sectional view of the detection member that has been inserted into the innermost part of the passage part.

FIG. 18 illustrates the detection member 14 that has been inserted into the passage part 55. The detection member 14 of the male connector 10, which is formed like the detection member 4 of the female connector 1, has a shaft part 61, a contact part 62, and an engaging part 63. The lance 56, when the male terminal 13 is inserted to the regular position, allows the detection member 14 to be inserted into the innermost part of the passage part 55. The engaging part 63 of the detection member 14 is engaged with the engaging part 57 of the housing 12. That is to say, when the male terminal 13 is inserted to the regular position, the detection member 14 can move to the insertion completion position. The detection member 14 at the insertion completion position is housed in the passage part 55 in its entirety.

Figure 19:
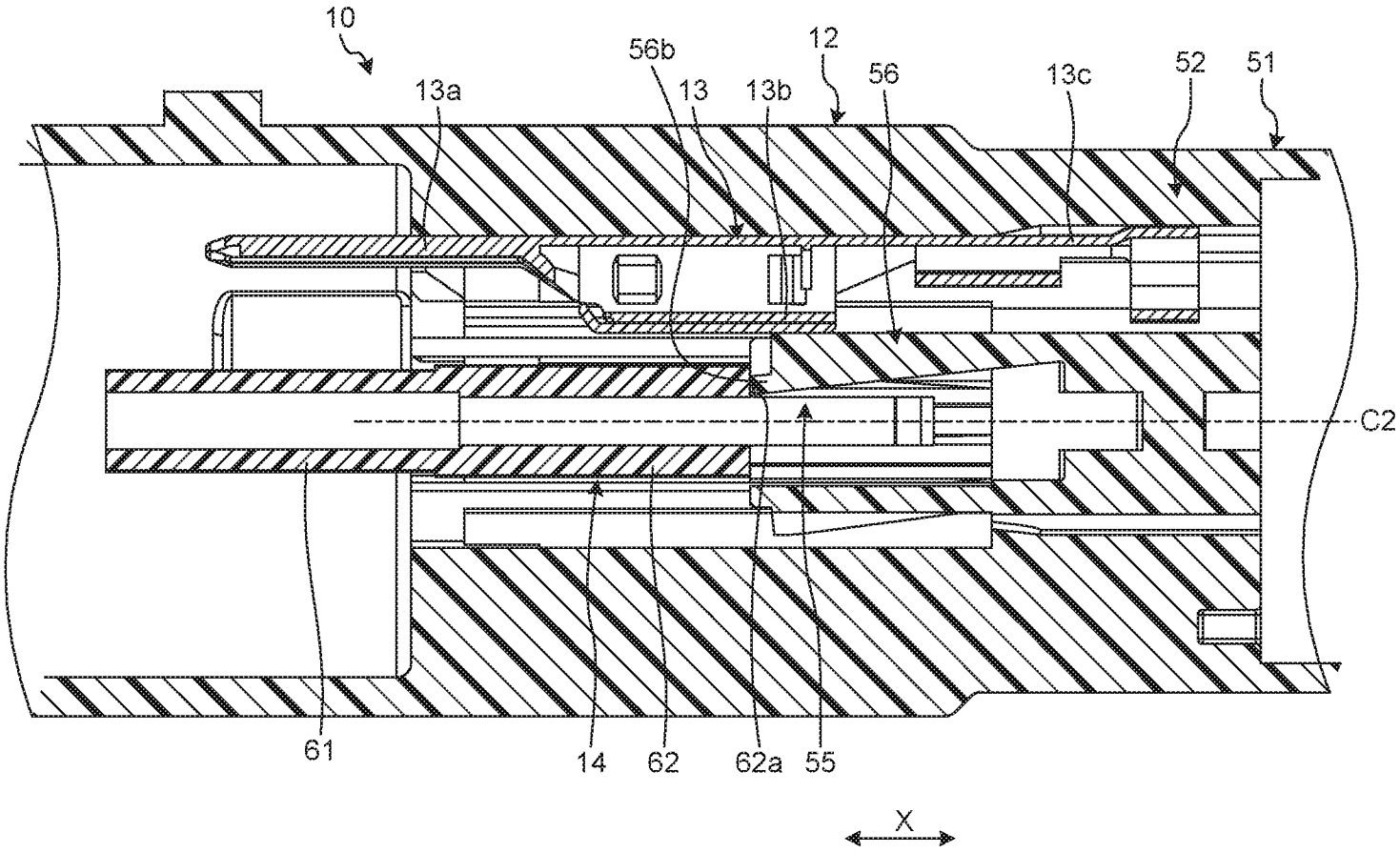
FIG. 19 is a sectional view of the detection member locked at the first position.

FIG. 19 illustrates the male terminal 13 that is not inserted to the regular position. The tubular part 13*b* of the male terminal 13, which overrides the lance 56, presses the lance 56 toward the center line C2. The lance 56 bends so as to be close to the center line C2 by a pressing force from the male terminal 13. The locking protrusion 56*b* of the lance 56 protrudes to the passage part 55. In this case, when being inserted into the passage part 55, the detection member 14 is locked at the first position by the lance 56 as illustrated in FIG. 19. In this process, the shaft part 61 of the detection member 14 protrudes from the passage part 55. Consequently, the operator can recognize that there are some male terminals 13 that are not inserted to the regular position.

As described in the foregoing, the female connector 1 of the present embodiment has the housing 2, the female terminals 3, and the detection member 4. The housing 2 has the terminal housing chambers 24, the one passage part 25, and the lances 26. The terminal housing chamber 24 has the terminal insertion port 24*a* opening toward one side in the axial direction X. The passage part 25 opens toward the other side in the axial direction X. The female terminal 3 is inserted into the terminal housing chamber 24 and is locked by the lance 26 at the regular position in the terminal housing chamber 24. The detection member 4 is a member that is inserted into the passage part 25 to detect whether the female terminal 3 is inserted to the regular position.

The passage part 25 is adjacent to each of the terminal housing chambers 24 in a direction orthogonal to the axial direction X. The lances 26 are provided at the boundary between the respective terminal housing chambers 24 and the passage part 25. The lances 26, when the respective female terminals 3 are not inserted to the regular position, are pressed by the respective female terminals 3 to protrude to the passage part 25 and to lock the detection member 4 at the first position in the passage part 25. On the other hand, the lances 26, when the respective female terminals 3 are inserted to the regular position, allow the detection member 4 to be inserted into the more inner position than the first position.

In the female connector 1 of the present embodiment, the contact part 42 locked by the lances 26 is shared by the terminal housing chambers 24. As a comparative example, a detection member having individual contact parts for the terminal housing chambers 24 is considered. In the case of the detection member of the comparative example, the contact part is divided into a plurality of pieces, and thus when the strength of the contact part is attempted to be increased, the detection member increases in size. In contrast, the detection member 4 of the present embodiment can reduce the contact part 42 in size while ensuring the strength of the contact part 42.

In the male connector 10 of the present embodiment, the housing 12 has the terminal housing chambers 54, the passage part 55, and the lances 56 similar to the terminal housing chambers 24, the passage part 25, and the lances 26, respectively, of the female connector 1. The male connector 10 has the detection member 14 similar to the detection member 4 of the female connector 1. Consequently, in the male connector 10, the contact part 62 can be reduced in size while ensuring the strength of the contact part 62.

In the female connector 1 and the male connector 10 of the embodiment, the terminal housing chambers 24 and 54 are disposed along the circumferential direction around the center lines C1 and C2, respectively, along the axial line X. The passage parts 25 and 55 extend along the center lines C1 and C2, respectively. With such a disposition, the passage parts 25 and 55 are effectively used as common spaces for the lances 26 and 56, respectively, to bend.

The housings 2 and 12 of the present embodiment have the pillar parts 22*g* and 52*g*, respectively. The pillar parts 22*g* and 52*g*, both ends of which in the axial direction X are supported, extend along the passage parts 25 and 55, respectively. The lances 26 and 56 are integrally formed with the respective pillar parts 22*g* and 52*g*, respectively. Consequently, the lances 26 and 56 can be reduced in size compared with a case in which the lances 26 and 56 are cantilevered.

First Modification of Embodiment

Figure 20:
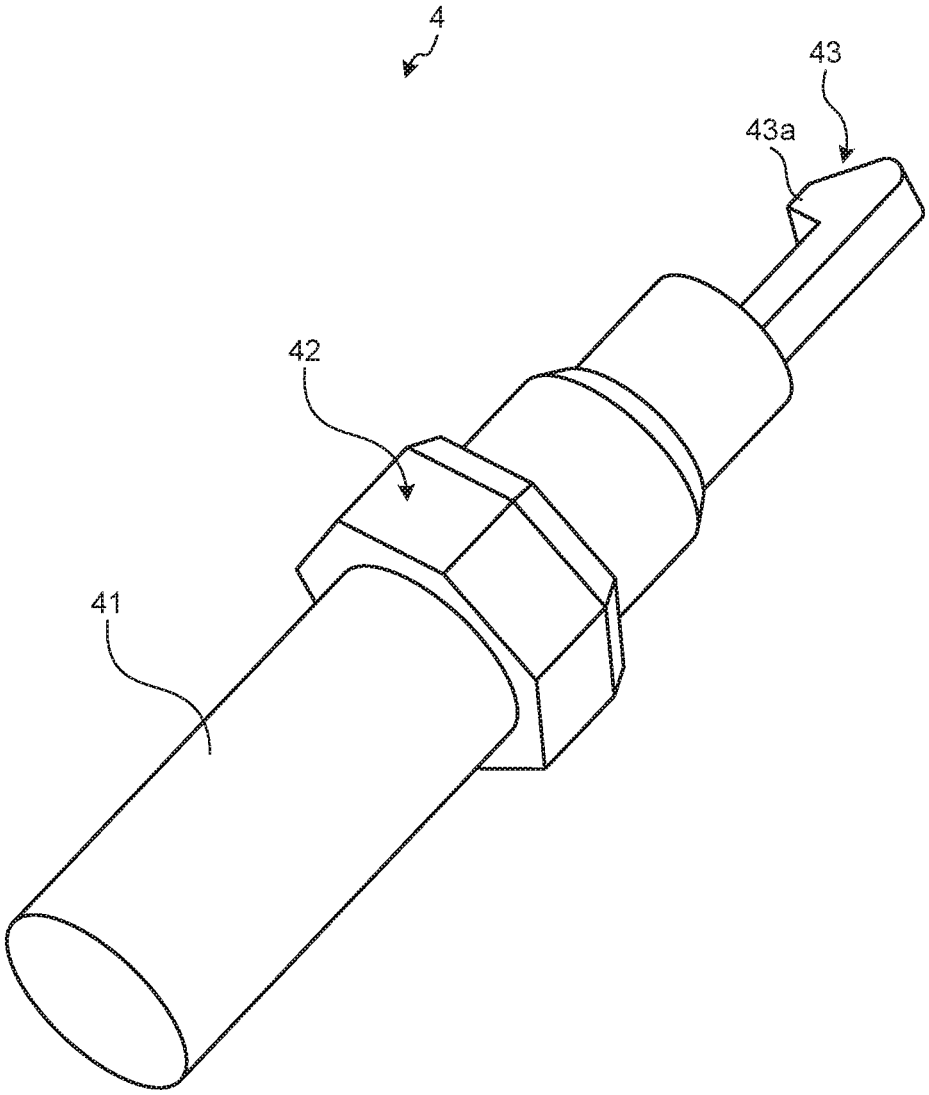
FIG. 20 is a perspective view of the detection member according to a first modification of the embodiment.
Figure 21:
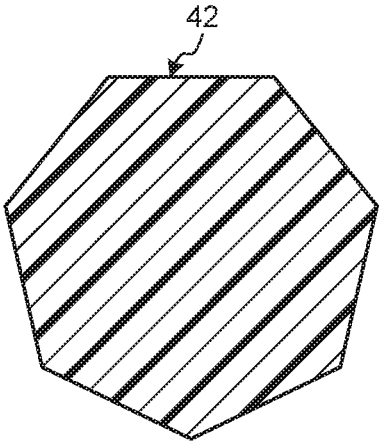
FIG. 21 is a sectional view of a contact part according to the first modification of the embodiment.

The following describes a first modification of the embodiment. FIG. 20 is a perspective view of the detection member according to the first modification of the embodiment. FIG. 21 is a sectional view of the contact part according to the first modification of the embodiment. The detection member 4 of the first modification is different from the detection members 4 and 14 of the embodiment in the shape of the contact part 42. As illustrated in FIG. 21, the sectional shape of the contact part 42 according to the first modification is polygonal.

The sectional shape of the contact part 42 is preferably polygonal corresponding to the number of the terminal housing chambers 24 of the housing 2 of the female connector 1 or the number of the terminal housing chambers 54 of the housing 12 of the male connector 10. When the housing 2 of the female connector 1 has seven terminal housing chambers 24, for example, the sectional shape of the contact part 42 is made heptagonal. With this configuration, the sectional area of the contact part 42 can be maximized to the extent that it does not interfere with the lances 26, and the rigidity of the contact part 42 can be improved. When the female terminal 3 is in the semi-insertion state, the contact part 42 is locked by the lance 26 more surely.

When the terminal housing chambers 24 and 54 are disposed at regular intervals along the circumferential direction, the sectional shape of the contact part 42 is preferably regularly polygonal. When seven terminal housing chambers 24 are disposed at regular intervals along the circumferential direction in the female connector 1, for example, the sectional shape of the contact part 42 is preferably made regularly heptagonal.

Second Modification of Embodiment

The following describes a second modification of the embodiment. The number of the terminal housing chambers 24 and 54 is not limited to the exemplified number. The housings 2 and 12 are only required to have a plurality of terminal housing chambers 24 and 54, respectively. The disposition and shape of the lances 26 and 56 are not limited to the exemplified disposition and shape. The lances 26 and 56 are not necessarily integral with the pillar parts 22*g* and 52*g*, respectively, for example.

The shape of the detection members 4 and 14 is not limited to the exemplified shape. The shape of the engaging parts 27 and 57 of the housings 2 and 12, respectively, is not limited to the exemplified shape. The engaging parts 43 and 63 and the engaging parts 27 and 57 may be able to be engaged with each other, respectively, regardless of the phase of the detection members 4 and 14, respectively, for example.

The details disclosed in the embodiment and the modifications can be performed in an appropriately combined manner.

In the connector according to the embodiment, one passage part is adjacent to each of the terminal housing chambers. The lances are provided at the boundary between the respective terminal housing chambers and the passage part. The lances, when the respective terminals are not inserted to the regular position, are pressed by the respective terminals to protrude to the passage part and to lock the detection member at the first position in the passage part and, when the respective terminals are inserted to the regular position, allow the detection member to be inserted into the more inner position than the first position. In the connector according to the embodiment, the contact part of the detection member locked by the lances is shared by the terminal housing chambers. Consequently, it produces an effect of making it possible to achieve both ensuring strength of the detection member and preventing an increase in the size of the detection member.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a housing having a plurality of terminal housing chambers each having an insertion port opening toward one side in an axial direction, one passage part opening toward another side in the axial direction, and lances;

terminals inserted into the respective terminal housing chambers and locked by the respective lances at a regular position in the respective terminal housing chambers; and a detection member configured to be inserted into the passage part to detect whether the terminals are inserted to the regular position, wherein the passage part being adjacent to each of the terminal housing chambers in a direction orthogonal to the axial direction, each of the lances being provided at a boundary between the respective terminal housing chambers and the passage part, the lances are configured to be pressed by the respective terminals to protrude to the passage part and to lock the detection member at a first position in the passage part when the respective terminals are not inserted to the regular position, and the lances are configured to allow the detection member to be inserted into a more inner position than the first position when the respective terminals are inserted to the regular position.

2. The connector according to claim 1, wherein the terminal housing chambers are disposed along a circumferential direction around a center line along the axial direction, and the passage part extends along the center line.

3. The connector according to claim 2, wherein the terminal housing chambers are disposed at regular intervals around the center line, the detection member has a contact part locked by the lances when the respective terminals are not inserted to the regular position, and a sectional shape of the contact part is regularly polygonal shape corresponding to number of the terminal housing chambers of the housing.

4. The connector according to claim 1, wherein the housing has pillar parts extending along the passage part, both ends of the pillar part in an axial direction are supported, and the lances are integrally formed with the respective pillar parts.

5. The connector according to claim 2, wherein the housing has pillar parts extending along the passage part, both ends of the pillar part in an axial direction are supported, and the lances are integrally formed with the respective pillar parts.

6. The connector according to claim 3, wherein the housing has pillar parts extending along the passage part, both ends of the pillar part in an axial direction are supported, and the lances are integrally formed with the respective pillar parts.

* * * * *